US011629442B2

(12) United States Patent
Klapp et al.

(10) Patent No.: US 11,629,442 B2
(45) Date of Patent: Apr. 18, 2023

(54) DEVICE FOR FASTENING A GRIPPER ON A GRIPPER SHAFT OF A TEXTILE MACHINE

(71) Applicant: Nähmaschinenfabrik Emil Stutznäcker GmbH & Co. KG, Cologne (DE)

(72) Inventors: Hartmut Klapp, Kaarst (DE); Hans-Rochus Groß, Bergisch-Gladbach (DE)

(73) Assignee: Nähmaschinenfabrik Emil Stutznäcker GmbH & Co. KG, Cologne (DE)

( * ) Notice: Subject to any disclaimer, the term of this patent is extended or adjusted under 35 U.S.C. 154(b) by 325 days.

(21) Appl. No.: 16/866,916

(22) Filed: May 5, 2020

(65) Prior Publication Data

US 2020/0362493 A1 Nov. 19, 2020

(30) Foreign Application Priority Data

May 17, 2019 (DE) ..... 10 2019 113 151.0

(51) Int. Cl.
*D05B 57/00* (2006.01)

(52) U.S. Cl.
CPC ..... *D05B 57/00* (2013.01)

(58) Field of Classification Search
CPC ..... D05B 57/00; D05B 57/04; D05B 57/06; D05B 57/08; D05B 57/14
See application file for complete search history.

(56) References Cited

U.S. PATENT DOCUMENTS

| | | | | |
|---|---|---|---|---|
| 4,876,974 | A | 10/1989 | Ando | |
| 5,505,150 | A * | 4/1996 | James | D05C 15/16 112/117 |
| 5,718,180 | A * | 2/1998 | Stutznacker | D05C 11/04 112/117 |
| 2010/0126396 | A1* | 5/2010 | Stutznacker | D05B 55/14 112/285 |
| 2012/0097085 | A1 | 4/2012 | Fukao | |

FOREIGN PATENT DOCUMENTS

| | | |
|---|---|---|
| DE | 3400206 C2 | 1/1987 |
| DE | 19518063 A1 | 11/1996 |

* cited by examiner

*Primary Examiner* — Nathan E Durham
(74) *Attorney, Agent, or Firm* — Harness, Dickey & Pierce, P.L.C.

(57) ABSTRACT

A device for fastening a gripper on a gripper shaft of a textile machine, in particular a sewing machine, preferably a multi-needle sewing machine, with a support element for the gripper is described. The support element for the gripper is connected to a holder or the gripper shaft via a connecting element in such a way that the support element for the gripper is detachable from the holder or the gripper shaft. The connecting element is designed as a toggle screw or locking mechanism such that the toggle screw rotatably engages through a bore in the support element into a corresponding opening in the holder or the gripper shaft, engaging behind an abutment, or the locking mechanism is designed as a positive connection between the support element and the holder.

11 Claims, 13 Drawing Sheets

DEVICE FOR FASTENING A GRIPPER ON A GRIPPER SHAFT OF A TEXTILE MACHINE

CROSS-REFERENCE TO RELATED APPLICATIONS

This application claims the benefit and priority of German patent application No. DE 10 2019 113 151.0, filed May 17, 2019. The entire disclosure of the above application is incorporated herein by reference.

FIELD

The invention relates to a device for fastening a gripper on a gripper shaft of a textile machine, in particular a sewing machine, preferably a multi-needle sewing machine, with a holder and a support element for the gripper, wherein the support element for the gripper is connected to the support via a connecting element in such a way that the support element for the gripper can be detached from the support.

BACKGROUND

From DE 34 00 206 C2 a method for operating a sewing machine, in particular a multi-needle sewing machine that uses one or more needles or one or more grippers as stitch-forming tools is known. In this method, the sewing material is conveyed in any direction within a sewing material plane. It is provided that at least one of the stitch-forming tools including supports is displaced transversely to the plane of movement of the gripper depending on the needle bending caused by the conveyed sewing material in such a way that the distance between the needle in the region of the lowest operating position and the plane of movement of the gripper remains substantially the same. The arrangement of several grippers with gripper holder on a gripper shaft is known from this prior art.

A device of this type is known from DE 195 18 063 A1. This document discloses a multi-needle sewing machine with at least one needle bar and fixing devices for the individual needles and with at least one gripper shaft to which gripper holders with grippers are attached. Multi-needle sewing machines for sewing large-area sewing material such as quilts are equipped with a large number of needles per needle bar. If several needle bars are provided, especially two or three needle bars common to the needle row, the number of needles increases accordingly. The individual needles include grippers, which together with the needles are the main sewing elements. The grippers are fixed to common gripper shafts oscillating back and forth via gripper holders.

With such multi-needle sewing machines a considerable problem arises from the fact that the pattern to be sewn on the large-area material often has to be changed over. For this purpose, all needles or at least a large part thereof must be detached and mounted again in a different place on the respective needle bar. In order to prevent the upper threads from skewing or even crossing, they must usually be cut beforehand. Since the needles have so far mostly been attached to the needle bar by means of complicated screw connections, tools are required for removing the needles and re-attaching the needles in another place, usually special tools because the fastening devices are difficult to access. The same also applies analogously to the grippers or gripper holders with their lower threads. For the above reasons, changing over a multi-needle sewing machine to a different sewing pattern involves a considerable amount of work and time. For this purpose, DE 195 18 063 A1 proposes quick locking devices for both the needles or needle holders and/or the gripper holders of each gripper. This technology has proven itself and is still used today. For the grippers, this prior art concretely proposes a quick-locking device which has a locking clip which is articulated so as to be pivotable about a pivot pin of the gripper holder and grips around a part of the gripper shaft. With this prior art design, it is a disadvantage that a high clamping force is required between the locking clip and the gripper shaft to ensure that a gripper holder is firmly seated on the gripper shaft. This results in surface wear of the gripper shaft, which must be compensated for by repair.

Alternatively, a manually operated plug-type locking device is provided between the gripper and the gripper holder, for example in the form of a bayonet lock.

The conversion of a multi-needle sewing machine is, however, also connected with the fact that the grippers also require a certain adjustment in relation to the needles, as the grippers are to engage in thread loops formed by the needles below the material during the sewing process. This must be done with appropriate accuracy so that the adjustment from hook to needle must also be as accurate as possible. Previously, this was done by loosening the gripper holders on the gripper shaft and pushing them towards or away from the needle before the grippers were again fixed on the gripper shaft. This process is very time-consuming and also error-prone so that damage to the sewing elements can always be found. Moreover, the adjustment of the gripper holders on the gripper shaft is a very filigree work due to the very limited space in this area. Since the alignment of the hook to the needle is not necessarily visible without auxiliary means, small mirrors are used to check the setting. This is done during the adjustment process so that the person performing this operation holds the mirror with one hand and makes the adjustment with the second hand.

SUMMARY

Based on this prior art, it is an object of the invention to further develop a device of the type described in such a way that the attachment of the grippers to the gripper shaft is as simple and thus quick as possible, while ensuring a sufficiently secure hold.

The solution of this object provides that the connecting screw is designed as a toggle screw or as a locking mechanism, wherein the toggle screw rotatably engages through a bore in the support element into a corresponding opening in the holder or gripper shaft, gripping behind an abutment, or wherein the locking mechanism is designed as a positive connection between the support element and the holder.

In contrast to prior art, a toggle screw in combination with an abutment is provided in the device according to a first embodiment of the invention. The toggle screw engages through a bore in the support element and is freely rotatably supported in this element. The abutment is arranged in the holder or in the gripper shaft and can, for example, be provided as a projection in a bore, and the toggle screw engages behind this projection by turning and thus fixes the support element to the holder or the gripper shaft. The design with a holder also has the advantage that the holder can be arranged and fixed variably in the axial direction of the gripper shaft. This means that the gripper shaft can be free of bores to accommodate fastening elements. Incidentally, the abutment can also be bayonet-like and interact with a projection on the toggle screw, and it is advantageous if the design consisting of toggle screw and abutment also serves to clamp the support element to the holder or the gripper shaft. In addition, spring elements may be provided to hold the connection and tension between the support element and the holder or the gripper shaft to prevent unintentional release during operation of the textile machine.

In the second embodiment of the device according to the invention, a locking mechanism is provided between the support element and the holder or the gripper shaft. This locking mechanism can be, for example, a kind of clip fastener with which the support element is fixed to the holder or the gripper shaft. This is a form-fit connection in which it is important that the support element is firmly seated on the bracket or the gripper shaft and which is described below.

In both embodiments of the invention, the support element with the gripper can be easily detached from the holder or the gripper shaft. In the first embodiment, the support element is connected to the holder via the toggle screw. The toggle screw is designed in such a way that a high-strength connection can be made with a slight rotation. For this purpose, the toggle screw engages in the holder or the gripper shaft and can be rotated by 45° for example so that, for example, a projection at the free end of the toggle screw engages behind a projection in the bore in the holder or the gripper shaft and is clamped there. The projection in the bore can be designed as an inclined surface that interacts with the projection on the toggle screw so that the projection on the toggle screw is guided along the projection in the bore and the toggle screw is pulled into the bore in the longitudinal axis direction.

As far as the invention is described in the following with regard to a fastening of the support element to the holder, this shall of course also cover an embodiment in which direct fastening of the support element to the gripper shaft is provided.

Preferably, the toggle screw has a radially extending shoulder at its free end, i.e. the end protruding from the support element, which makes it easier to rotate the toggle screw. However, it is also possible that the toggle screw has a tool surface on its front side, which can be operated with a screwdriver, for example, but also with a wrench.

An alternative design of the connecting element is the locking of the support element to the holder. This provides a form-fit connection between the support element and the holder. In this embodiment, the support element is slid onto the holder until the two components become locked. To remove the support element, the locking is released and the support element can be removed from the holder.

In order to ensure easy mounting of the holder on the gripper shaft, the holder is designed in two parts, and the two parts are connected to each other, for example, by screws oriented at right angles to each other. The holder also has an opening corresponding to the gripper shaft. As a rule, this opening is circular in shape. The opening has an inner diameter which is slightly smaller than the diameter of the gripper shaft so that the holder can be clamped to the gripper shaft by means of the screws.

In the first embodiment of the support element, the same is L-shaped and has two legs. One leg has a seat for the gripper and a second leg has an adjusting device. As a rule, the gripper has a cylindrical shoulder which can be inserted into a corresponding opening in the leg and fixed by means of an adjusting screw. The orientation of this fixing screw is usually parallel to the orientation of the course of the adjusting device. The second leg is adjusted relative to the holder via the adjusting device in this second leg, whereby the first leg performs a movement parallel to the longitudinal axis direction of the gripper shaft. Preferably, the support element is arranged with at least one section at a distance from the holder. Preferably, this is the part of the leg that carries the gripper and is arranged opposite the holder. The distance between the leg of the support element and the holder allows a friction-free adjustment in this area.

In order to simplify the assembly or disassembly and the adjustment of the support element relative to the holder, a further feature of the invention provides that the bore for the eccentric and the opening for the toggle screw are arranged in parallel in the holder. Both the eccentric as well as the toggle screw are therefore provided, for example, at the more easily accessible front side of the holder, so that they are easily accessible both during assembly/disassembly of the support element and during adjustment of the support element relative to the holder. It can also be seen that both the toggle screw and the eccentric are visible without any aids and can be operated without any tools.

The eccentric has a first section which is rotatably supported centrally in the bore of the holder and a second section which is eccentrically offset from the first section and engages in a bore in the support element. Accordingly, the eccentric is inserted with its first section into a correspondingly formed bore in the holder. This bore is formed with an internal thread which interacts with the external thread of the eccentric.

The first section of the eccentric terminates flush with the surface of the holder so that this section does not engage in the opening of the support element which is designed as an elongated hole, for example. The second section of the eccentric engages in this opening in such a way that a part of the outer surface of this second section abuts the inner wall of the opening. A rotation of the eccentric causes the abutting part of the second section to be displaced along the inner circumferential surface of the opening, whereby the second section of the eccentric exerts an adjusting force on the support element so that the latter is adjusted relative to the holder.

Preferably, the eccentric has a slot at the front face to accommodate an adjusting tool, for example a screwdriver. This design allows easy adjustment with a simply designed tool. Alternatively, the eccentric can have wrench flats on its outer surface for interaction with a box wrench or jaw spanner.

Furthermore, it is provided that the toggle screw has a T-shaped hammer head at its end facing the holder, which hammer head engages behind a projection in the opening, and that the toggle screw is clamped against the holder by means of a spring, preferably a disk spring. In this preferred embodiment, the toggle screw with the hammer head can be inserted into the bore of the holder and then rotated through a certain angle, whereby the hammer head engages behind the projection and the toggle screw is pulled into the bore in the axial direction. At the same time, the spring is tensioned in such a way that the spring tension causes the toggle screw to be firmly positioned in the bore and the opening of the support element and holds it in position. Subsequently, the fine adjustment of the support element and thus of the gripper relative to the holder and thus relative to the needle can be carried out via the adjusting device, for example the eccentric. A complex adjustment of the previously correctly mounted holder on the gripper shaft is no longer necessary. A very precise and sensitive adjustment of the gripper tip relative to the needle is possible.

According to a further feature of the invention, the toggle screw on the support element is secured against dropping out by a ring. The toggle screw passes through the opening in the support element and is rotatably mounted in this opening. A diameter expansion of the toggle screw prevents the toggle screw from being pushed through the opening. After inserting the toggle screw into the opening, a ring is attached on the opposite side which engages in an annular groove of the toggle screw and protrudes beyond the outer diameter of the toggle screw in this area, thus preventing the toggle screw from being pushed back and out of the opening in the support element. The toggle screw is thus captively fastened to the support element so that the support element and toggle screw together with the gripper form a component that can be mounted in one piece to the holder or removed from the holder. This is easily done by loosening the toggle screw so that it can be pulled out of the bore of the holder.

In the second embodiment of the device according to the invention, it is provided that the support element is substantially L-shaped and has two legs extending at right angles to each other and a first locking element provided on one leg, which interacts with a second locking element provided on the holder. This is the embodiment of the invention in which the connecting elements designed as locking elements form a locking mechanism between the support element and the holder. The two legs extending at right angles to one another are arranged in such a way that these two legs rest against two surfaces of the holder extending at right angles to one another. The support element can thus be slid onto the holder, which is already mounted on the gripper shaft, and locked to it so that a positive and firm connection between the support element and the holder is possible.

Preferably, the support element has first connecting elements that are arranged in second, correspondingly designed connecting elements of the holder so that the support element is positively connected to the holder. This can be, for example, a combination of a cylindrical pin on the support element and a corresponding bore on the holder. The support element is inserted into the bore with this pin and is thus fixed in its orientation. The support element can now be pivoted about this pin via the adjusting element in order to move its gripper tip towards or away from the needle.

For simplified mounting and dismounting of the support element on the holder, it has proven to be advantageous to make the support element elastically bending so that in particular parts of the two legs of the support element can be pushed onto the holder under a certain preload and a frictional connection is also provided in addition to the positive connection to connect the support element to the holder. In order to remove the support element from the holder in a simple manner, a finger engagement feature is provided on the support element. This finger engagement feature can be used to move the locking elements on the legs in such a way that the locking between the support element and the holder is released. At the same time, the frictional connection between the support element and the device is released so that the support element can subsequently be pulled off the holder. The finger engagement feature is preferably designed as an extension of a leg so that it can be actuated, for example, by grasping the support element with the index finger and thumb and subsequently applying a force to the finger placement feature via the thumb.

DRAWINGS

Further features and advantages of the invention will become apparent from the following description of the attached drawings in which preferred embodiments of the device according to the invention are shown.

DETAILED DESCRIPTION

Figure 1:
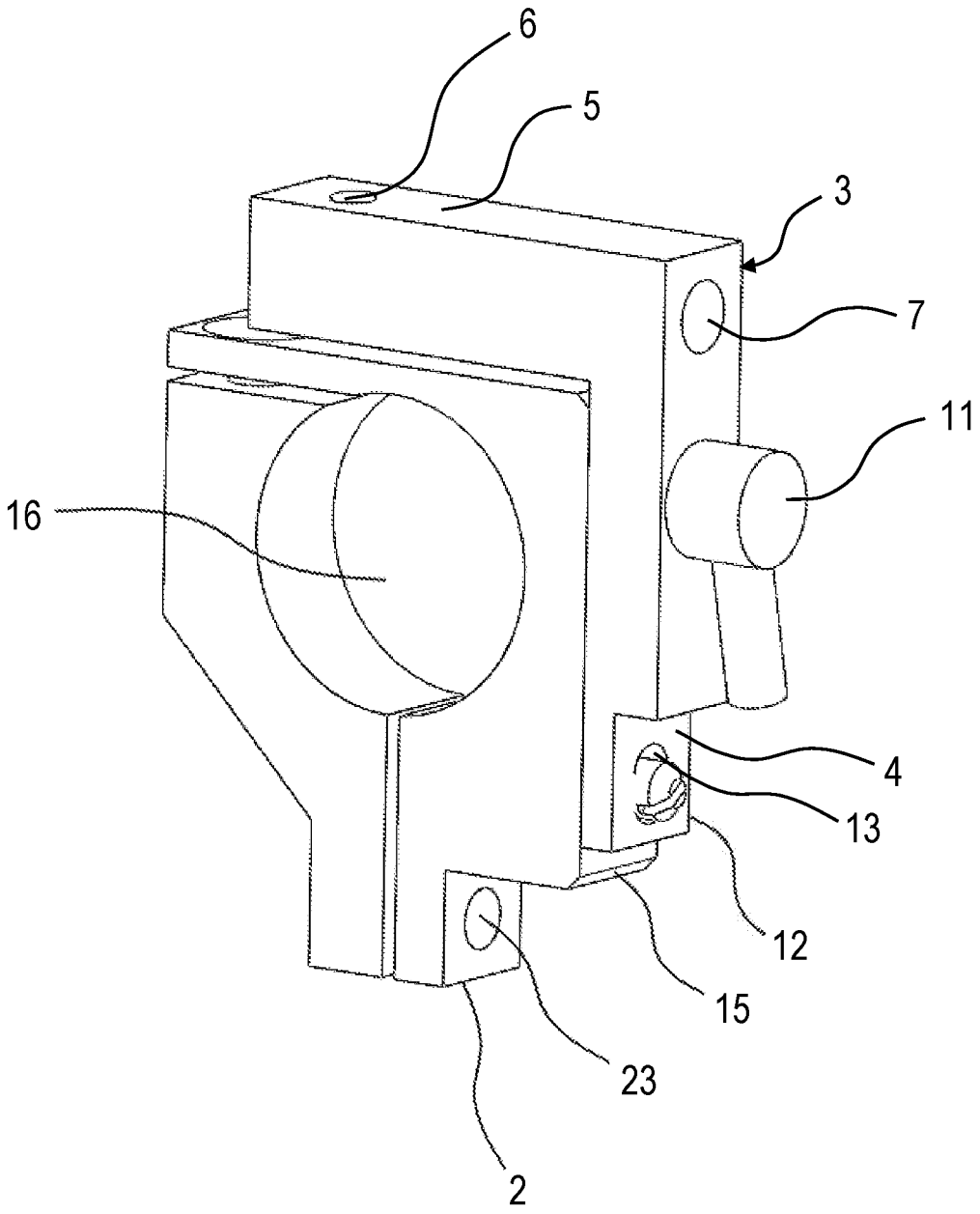
FIG. 1 shows a first embodiment of a device according to the invention in a perspective view.
Figure 2:
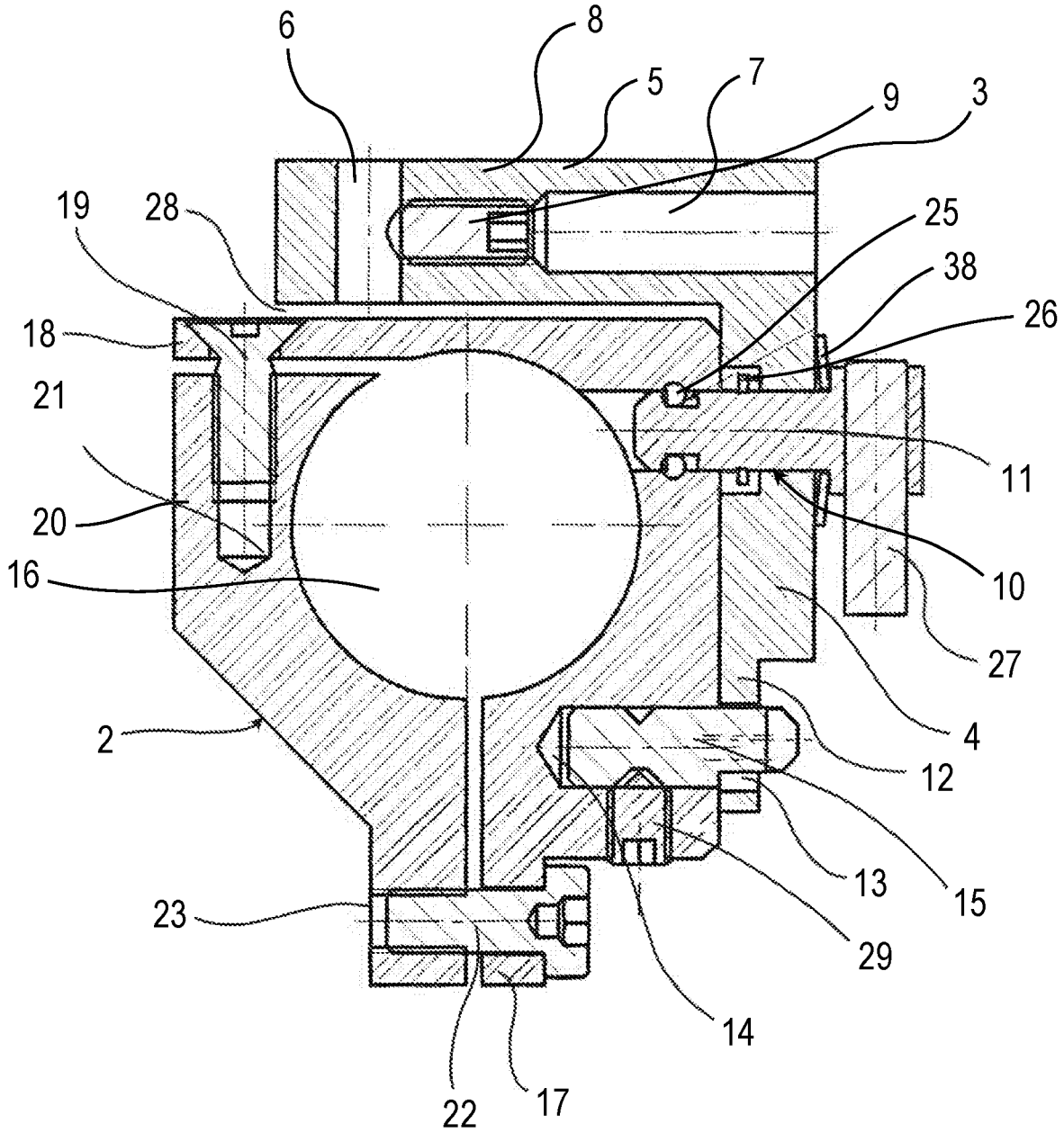
FIG. 2 shows the device according to FIG. 1 in a sectional side view along the section line II-II in FIG. 3.
Figure 3:
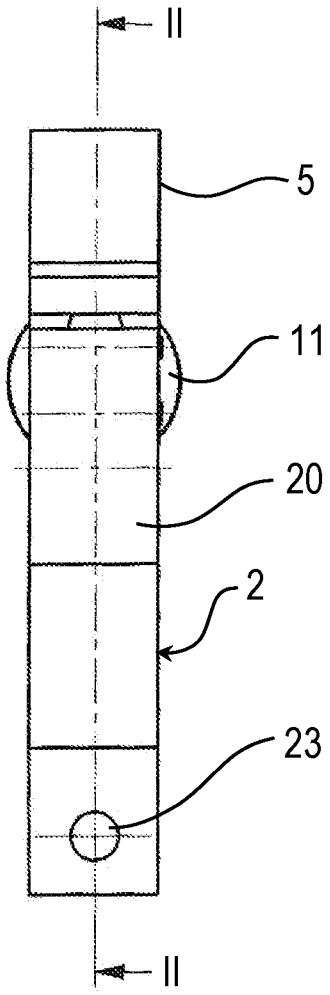
FIG. 3 shows the device according to FIGS. 1 and 2 in a view.
Figure 4:
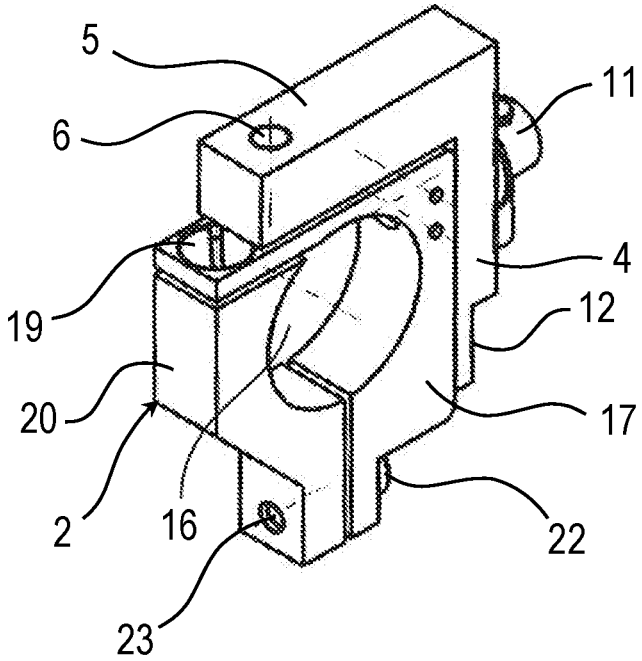
FIG. 4 shows the device according to FIGS. 1 to 3 in a further perspective view.
Figure 5:
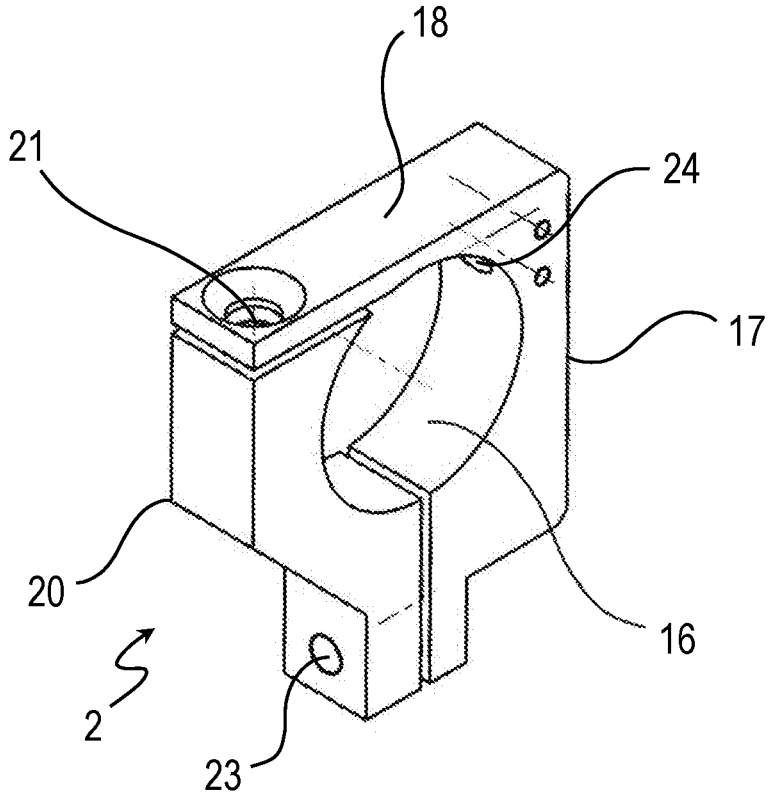
FIG. 5 shows a holder as part of the device according to FIGS. 1 to 4 in a perspective view.
Figure 6:
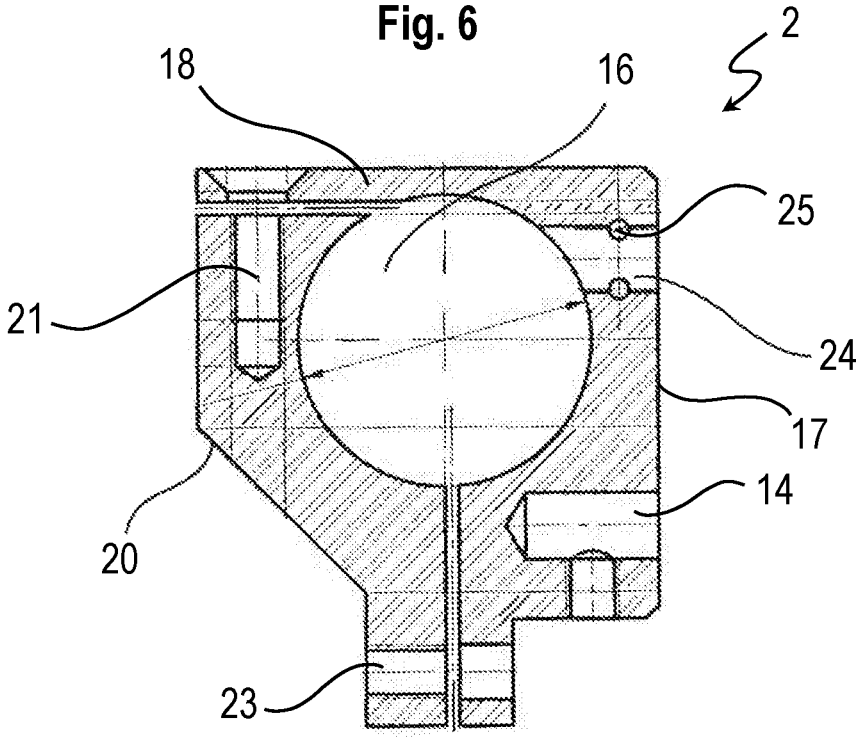
FIG. 6 shows the holder according to FIG. 5 in a sectional view along the section line VI-VI in FIG. 8.
Figure 7:
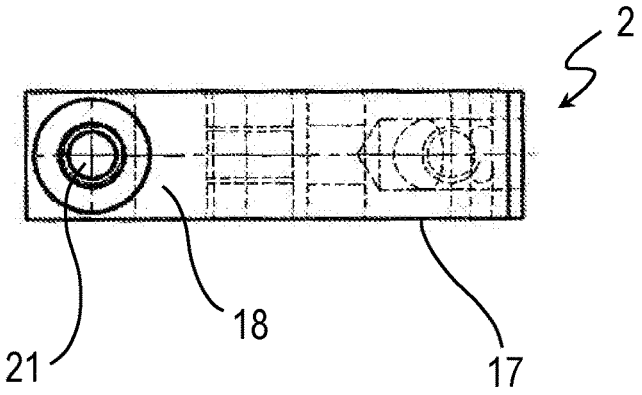
FIG. 7 shows the holder according to FIGS. 5 and 6 in a plan view.
Figure 8:
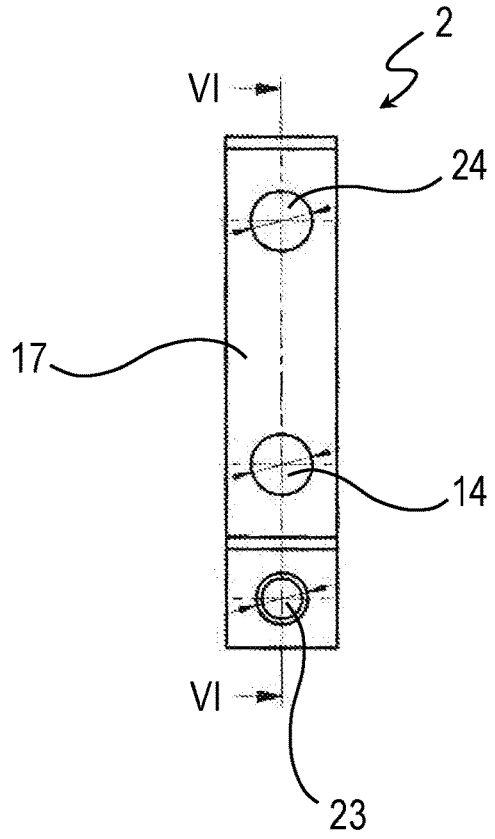
FIG. 8 shows the holder according to FIGS. 6 to 7 in a side view.
Figure 9:
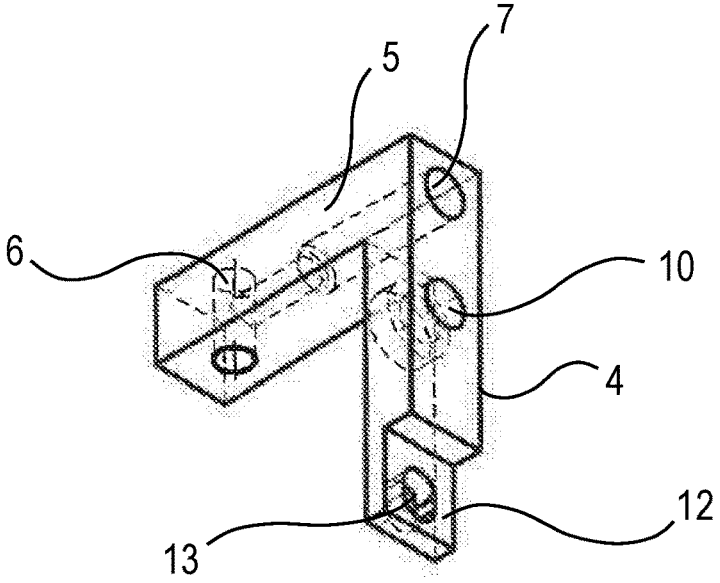
FIG. 9 shows a support element as part of the device according to FIGS. 1 to 4 in a perspective view.
Figure 10:
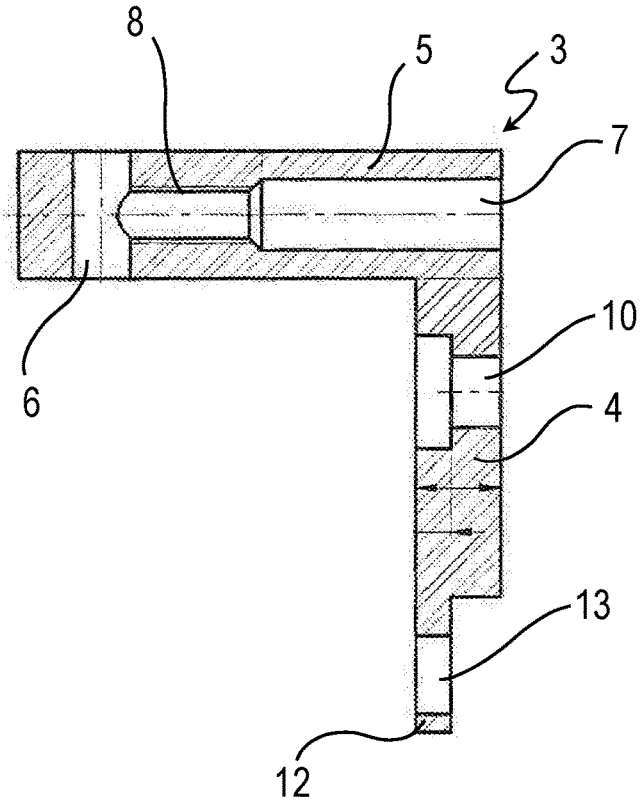
FIG. 10 shows the support element according to FIG. 9 in a sectional side view along the section line X-X according to FIG. 12.
Figure 11:
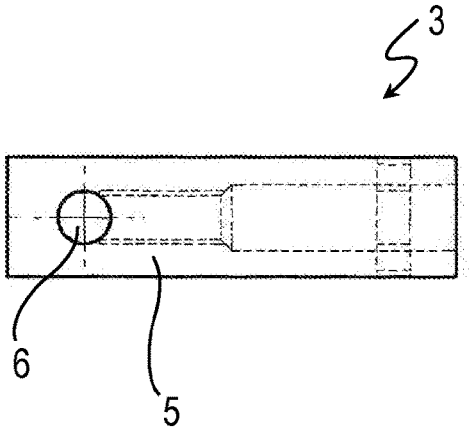
FIG. 11 shows the support element according to FIGS. 9 and 10 in a plan view.
Figure 12:
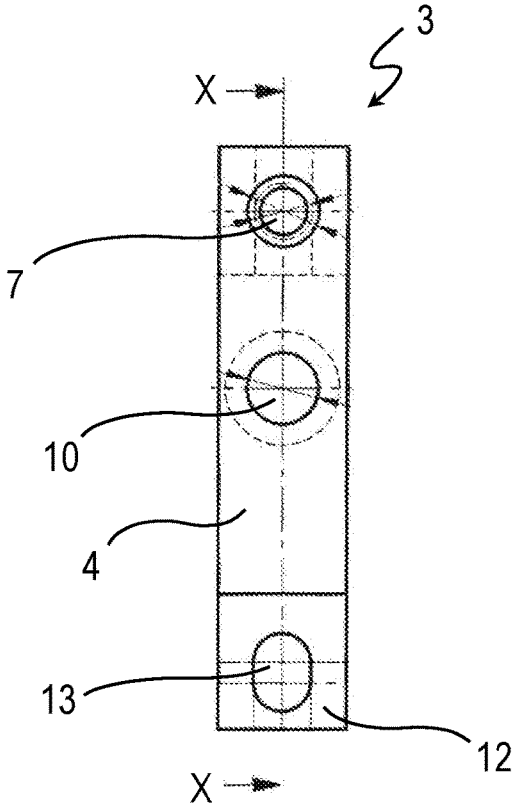
FIG. 12 shows the support element according to FIGS. 9 to 11 in a front view.

FIG. 1 shows a device for attaching a gripper 1 (FIGS. 21 to 25 and 28) in a perspective view. The device consists of a holder 2 and a support element 3 detachably mounted to it. The support element 3 is L-shaped and has a first leg 4 and a second leg 5 which are oriented at right angles to each other.

The second leg 5 has a bore 6 in the region of a free end which serves to accommodate a cylindrical section of the gripper 1. The bore 6 is oriented at right angles to the longitudinal extension of the leg 5. The first leg 4 has a bore 7 which extends through the first leg 4 in the direction of the longitudinal axis of the second leg 5 and ends in the region of the bore 6. In the region of this end of the bore 7, an internal thread 8 is formed which interacts with an external thread of a grub screw 9. The grub screw 9 serves to fix the cylindrical section of the gripper 1 in the bore 6 so that it is held in the support element 3. This secures the gripper 1 against dropping out and twisting relative to the support element.

The first leg 4 of the support element 3 has a further bore 10 which serves to accommodate a toggle screw 11 which is described in detail below with reference to FIGS. 13 to 16.

Finally, the first leg 4 has a further bore 13 in the area of a stepped section 12, which is designed as an elongated hole and is coaxially aligned with a bore 14 in the holder 2. An adjusting device 15 is inserted in the bores 13 and 14, which is described below with reference to FIGS. 17 to 20.

The holder 2 consists of two parts that are joined together to form an opening 16 to accommodate a gripper shaft not described in detail.

A first part 17 of the holder 2 is essentially L-shaped and has a first leg 18 which has a bore at its free end to receive a screw 19 by which the leg 18 is screwed to a second part 20 of the holder 2. For this purpose, the second part 20 has a threaded bore 21 with an internal thread, which has the same orientation as the bore 6 in the support element 3.

A second screw 22 passes through a further bore in the second leg 5 of the first part 17 of the support element 3, the screw 22 being oriented in its course at right angles to the course of the screw 19 and engages with its free end in an internally threaded bore 23 in the first part 17 of the support element 3.

In addition, the first leg 18 has a threaded bore 23 parallel to the bore 14, which serves to receive the free end of the toggle screw 11. A projection 25 in the form of two cylindrical pins is inserted into the bore 24 as an abutment for the toggle screw 11.

As can be seen, the bore 10 in the leg 4 of the support element 3 is formed with a part having a larger cross-section in which a locking ring 26 connected to the toggle screw 11 engages in such a way that the toggle screw 11 is secured against dropping out of the bore 10. In addition, the toggle screw 11 is designed with a radially protruding hand extension 27, which makes it easier to turn the toggle screw 11.

As can be seen, the support element 3 rests with its leg 4 against an end face of the holder 2, namely the first part 17. The second leg 5 of the support element 3 is, on the other hand, arranged at a distance from an end face of the first part 17 of the holder 2, forming a gap 28, so that no friction is to be overcome in this region when the support element 3 moves relative to the holder 2 via the adjusting device 15. The corresponding oppositely arranged surfaces of the leg 5 of the support element 3 and of the first part 17 of the holder 2 may otherwise be congruent. For example, surfaces in the form of sections of a circular arc, i.e. a concave surface, for example in the area of the first part 17 of the support 2 and a convex surface in the leg 5 of the support element 3, can be provided here.

Furthermore, it can be seen that the adjusting device 15 is secured against dropping out by a locking screw 29 in the bore 14.

FIGS. 5 to 8 show the holder 2 in detail. FIGS. 9 to 12 show the support element 3 in detail.

Figure 13:
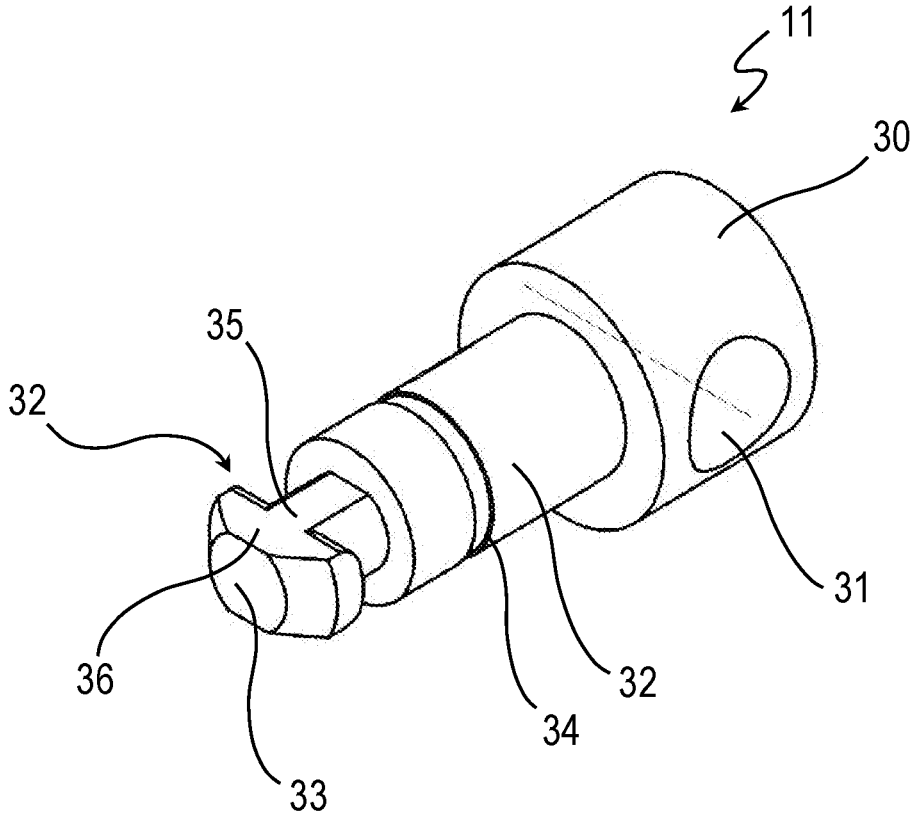
FIG. 13 shows a toggle screw in perspective view.
Figure 14:
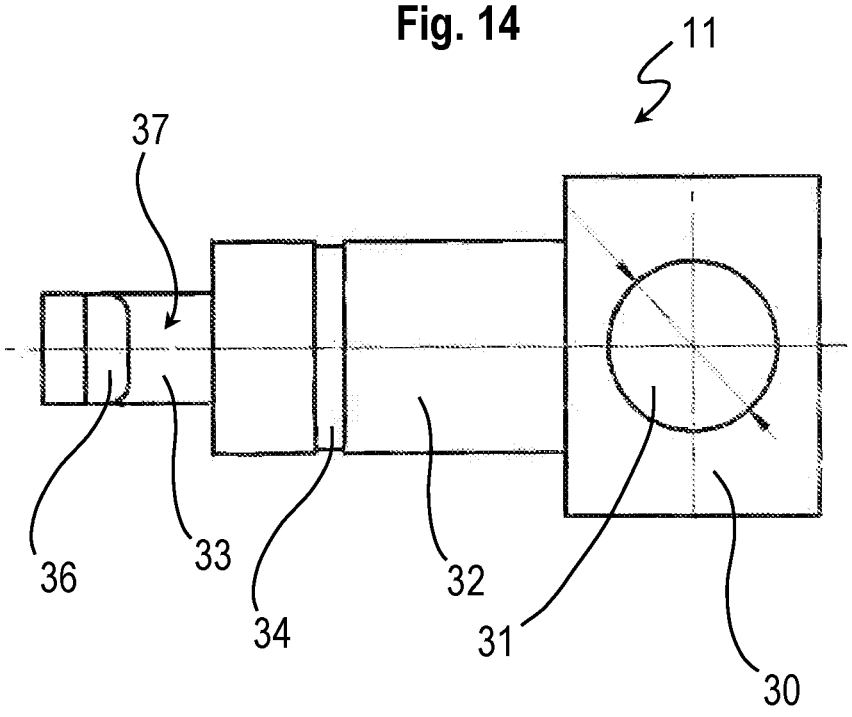
FIG. 14 shows the toggle screw according to FIG. 13 in a side view.
Figure 15:
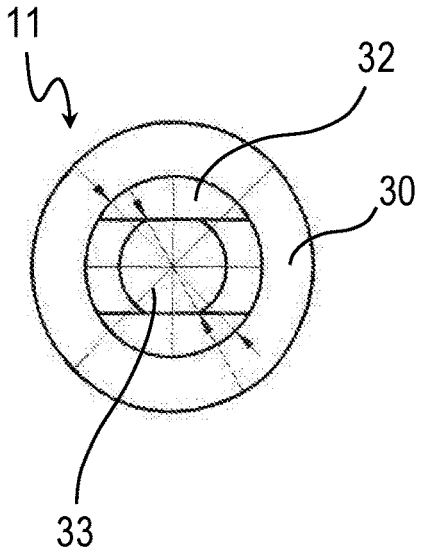
FIG. 15 shows the toggle screw according to FIGS. 13 and 14 in a front view.
Figure 16:
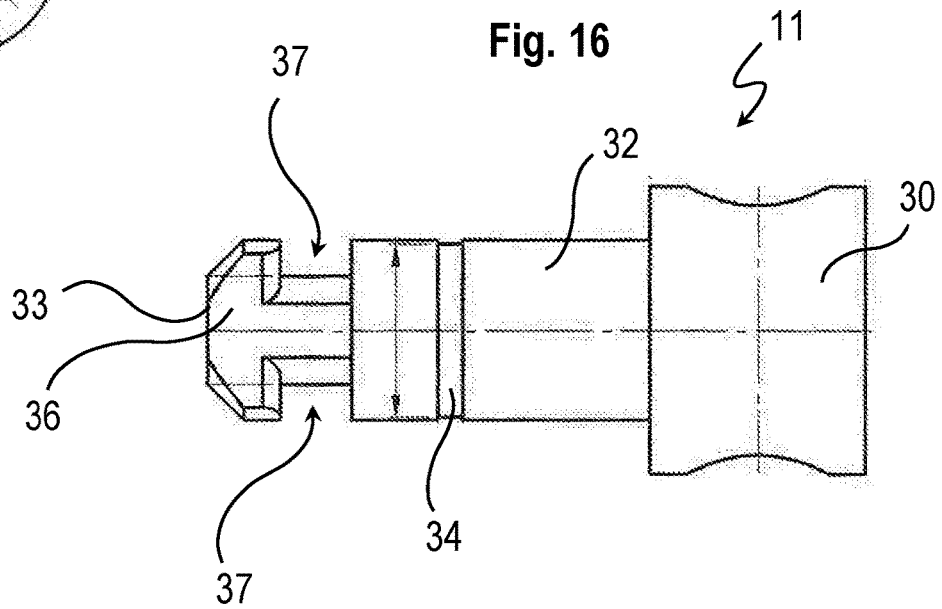
FIG. 16 shows the toggle screw according to FIG. 14 in a side view rotated by 90°.
Figure 17:
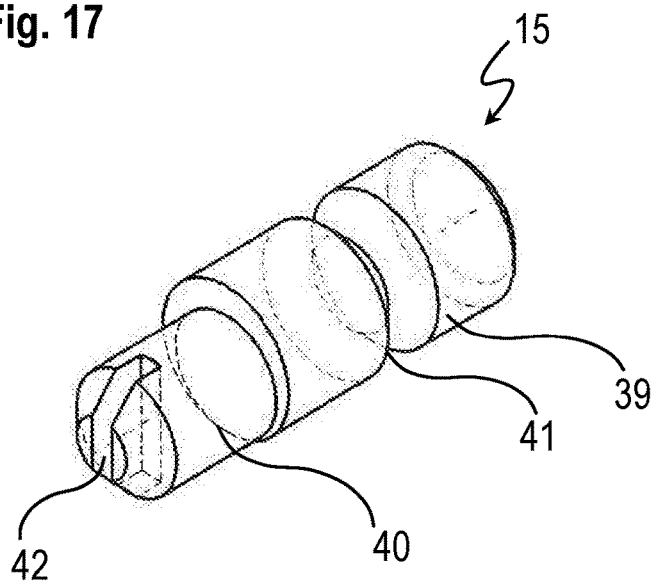
FIG. 17 shows an adjusting device in a perspective view.
Figure 18:
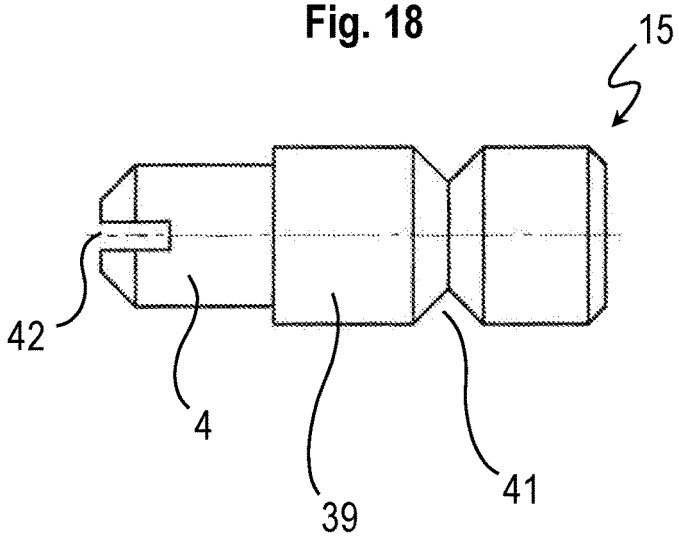
FIG. 18 shows the adjusting device according to FIG. 17 in a first side view.
Figure 19:
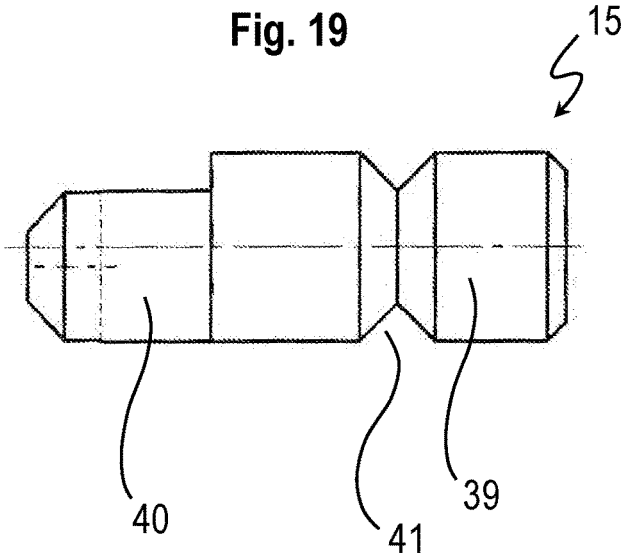
FIG. 19 shows the adjusting device according to FIG. 18 in a second view rotated by 90°.
Figure 20:
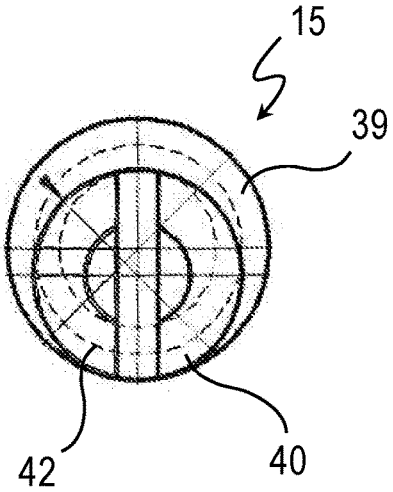
FIG. 20 shows the adjusting device according to FIGS. 17 to 19 in a front view.
Figure 21:
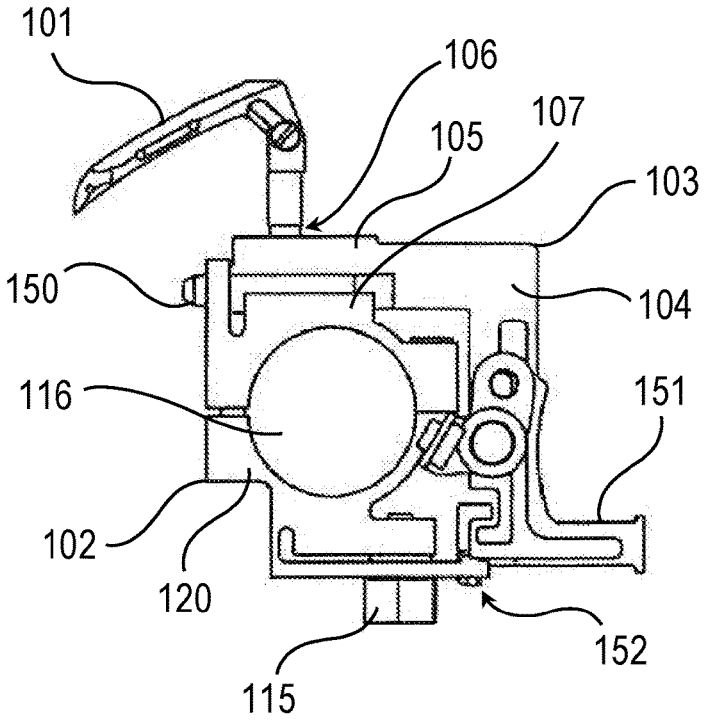
FIG. 21 shows a second embodiment of a device according to the invention in a side view.
Figure 22:
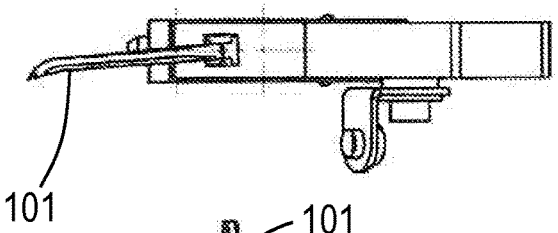
FIG. 22 shows the device according to FIG. 21 in a plan view.
Figure 23:
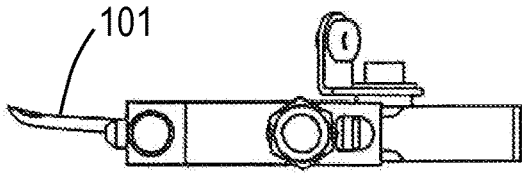
FIG. 23 shows the device according to FIGS. 21 and 22 in a bottom view.
Figure 24:
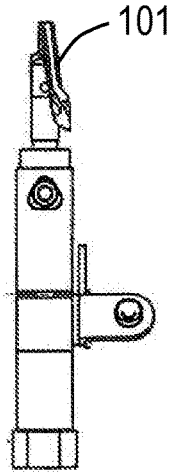
FIG. 24 shows the device according to FIGS. 21 to 23 in a first front view.
Figure 25:
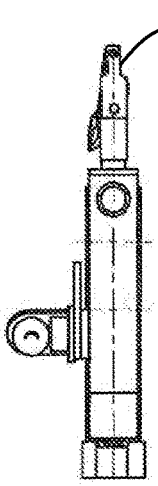
FIG. 25 shows the device according to FIGS. 21 to 24 in a second front view.

FIGS. 13 to 14 show the toggle screw 11. A head 30 with an axial bore 31 for receiving the hand engagement feature 27, which is not shown, can be seen. A cylindrical shaft 32 connects to the head 30, and on the front side of this shaft a T-shaped hammer head 33 is arranged. The shaft 32 has an annular groove 34 which serves to receive the retaining ring 26. The retaining ring 26 is designed as a snap ring.

The hammer head 33 arranged at the front end of the shaft 32 has a web 35 that carries a cross bar 36 at the end so that two undercuts 37 are formed between the cross bar 36 and the front end of the shaft 32 by which the toggle screw 11 engages behind the cylindrical pins 25 in order to pull the toggle screw 11 into the bore 24 in the axial direction.

For secure fastening of the toggle screw 11, a cup spring 38 is also provided which is supported on one side on the head 30 of the toggle screw 11 and on the other on the end face of the leg 4 of the support element 3 and is preloaded when the toggle screw 11 is pulled into the bore 24.

FIGS. 17 to 20 show the adjusting device 15 in detail. The adjusting device 15 consists of a first cylindrical section 39 and a second cylindrical section 40 that is arranged at the first section 39 eccentrically to said first section 39. The section 40 has a smaller diameter than the section 39 and is arranged in such a way that part of its outer surface coincides with the outer surface of the section 39, as can be seen in particular in FIGS. 19 and 20.

In the first section 39, an annular groove 41, which is V-shaped in cross-section, is formed in which the locking screw 29 engages when the adjusting device 15 is mounted. The locking screw 29 fixes the adjusting device 15 in the axial direction in the bore 14.

The second section 40 has a slot 42 on the front side which serves to attach a tool not further shown, for example a screwdriver, in order to turn the adjusting device 15 in the bore 14.

Turning the adjusting device 15 moves the section 40 in the bore 13 of the section 12 so that the leg 4 is rotated around the shaft 32 of the toggle screw 11 via the outer surface of the section 40. This results in a slight pivoting of the leg 5 of the support element 3 relative to the holder 2, allowing a gripper 1 inserted in the bore 6 and secured by the grub screw 9 to be moved slightly with its tip towards or away from the needle in order to bring the gripper 1 into an optimum position in relation to the needle when carrying out the sewing process. Such an optimum position of the needle and the gripper 1 in relation to each other ensures that on the one hand a collision between the gripper tip and the needle is prevented and on the other hand that the sewing process with needle thread and looper thread is carried out correctly.

FIGS. 21 to 29 show a second embodiment of a device with a support element 103. The support element 103 has a first leg 104 and a second leg 105 which are oriented at right angles to each other.

The second leg 105 has a bore 106 in the region of a free end which serves to receive a cylindrical section of the gripper 101. The bore 106 is oriented at right angles to the longitudinal extension of the leg 105. In addition, the second leg 105 has a conically tapered socket pin 150 at the front end, which is formed in one piece with the leg 105.

Furthermore, the first leg 104 has a finger engagement feature 151 which extends at the free end of the first leg 104 at right angles to the longitudinal extension thereof. This finger engagement feature 151 serves to actuate a locking device 152, which is described in detail below.

The holder 102 consists of two parts which are connected to each other to form an opening 116 for receiving a gripper shaft not further illustrated. A first part 117 is essentially U-shaped and connected to a second part 120 which is also essentially U-shaped. The holder 102 is shown in detail in FIG. 27, the division of the holder 102 into the parts 117 and 120 being indicated by lines 153 in FIG. 27. The first part 117 has a plate-shaped section 154 with a bore 155. The bore 155 is used to receive the socket pin 150 for fixing the support element 103 to the holder 102. The second part 120 has a tongue-like section 156 which is connected to the part 120 with limited elasticity. The elasticity is provided by two semicircular notches 157. Furthermore, the section 156 has an elongate hole 158 extending in its longitudinal direction and two locking hooks 159 as part of the locking 152. The spaced apart locking hooks 159 form a guide in which a locking element 160 is guided. A prism-shaped guide element is formed between the looking hooks 159 on the bottom side, which on the one hand guides the support element 103 when it is attached to the holder 102 and on the other hand positively fixes the support element 103 and the holder 102 in the end position. Thus the support element 102 is positively fixed with regard to its attachment to the holder 102 by two positive-locking and prism-shaped guides. Furthermore, compared to prior art, no additional components are required with regard to the holder 102 to achieve the advantageous design.

The elongated hole 158 serves to accommodate an adjusting device 115 which is screwed to the part 120 above the section 156, the adjusting device 115 having an eccentric 114 which is supported so as to be rotatable relative to a screw 113, the screw 113 engaging in the part 120 and the eccentric 114 partially abutting the inner walls of the elongated hole 158 so that the section 156 can be deflected laterally relative to the part 120 of the holder 102 arranged above the section 156 by means of the rotation of the eccentric 114. Notches 157 are provided to support this possible deflection.

The locking hook 159 of the locking 152 interacts with the locking element 160 that is disposed at the free end of the leg 104 of the support element 103.

The locking element 160 is located at an L-shaped end of the finger engagement feature 151, and this end and thus the locking element 160 can be moved relative to the locking mechanism 152 in order to release the support element 103 from the holder 102 by engaging a finger.

The support element 103 with the gripper 101, which is fixed non-rotatably in the bore 106, is firmly connected to the holder 102 by the socket pin 150 on the one hand and by the locking mechanism 152 on the other.

The section 156 can be adjusted to the left or right and thus approximately in the direction of the longitudinal axis of the bore 106 within small limits via the adjusting device 115, namely the eccentric 114. This adjustment also moves the locking element 160 in the locking mechanism 152 accordingly, resulting in a slight adjustment of the support element 103 relative to the holder 102. This relative movement of the support element 103 to the holder 102 causes the tip of the gripper 101 to be moved towards or away from a needle not shown in detail so that fine adjustment of the gripper 101 to the needle is possible through the adjusting device 115 without first having to loosen and move the holder 102 on the gripper shaft not further shown.

Figure 26:
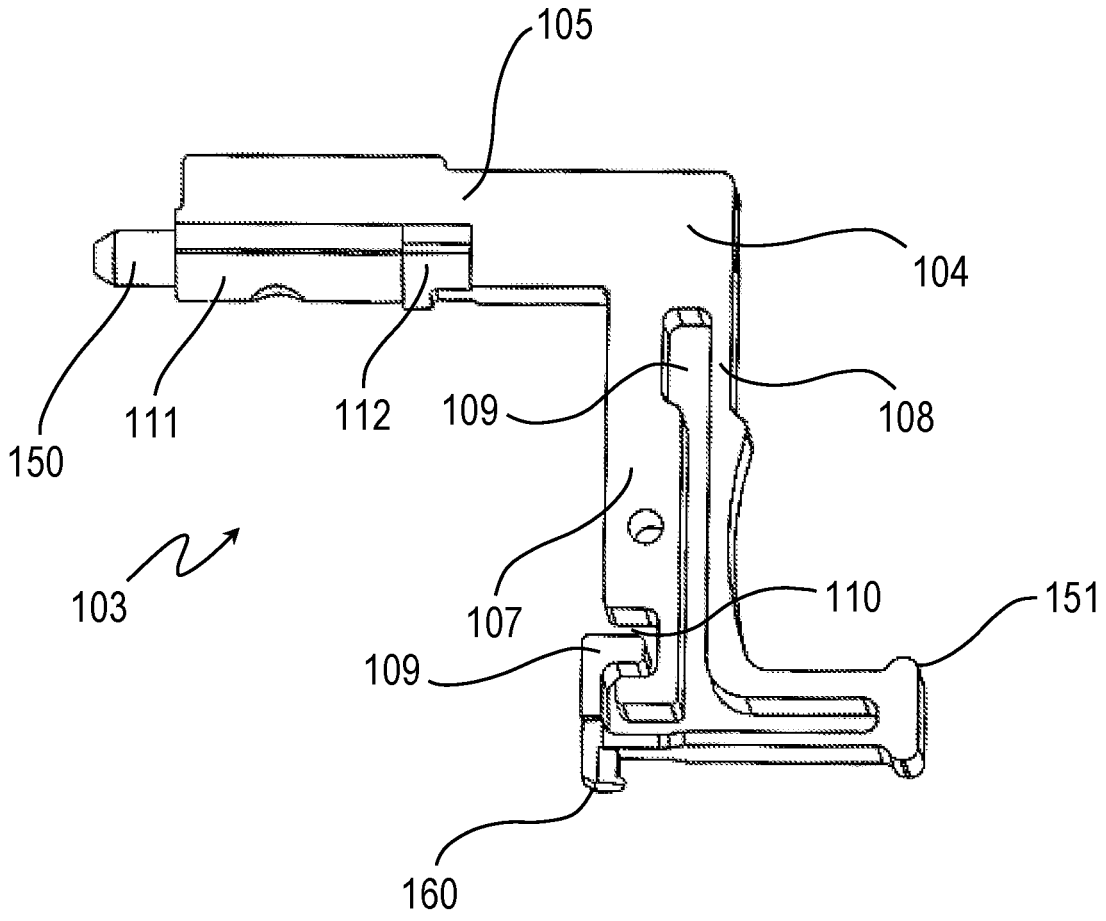
FIG. 26 shows a support element of the device according to FIGS. 21 to 25 in a perspective view.
Figure 27:
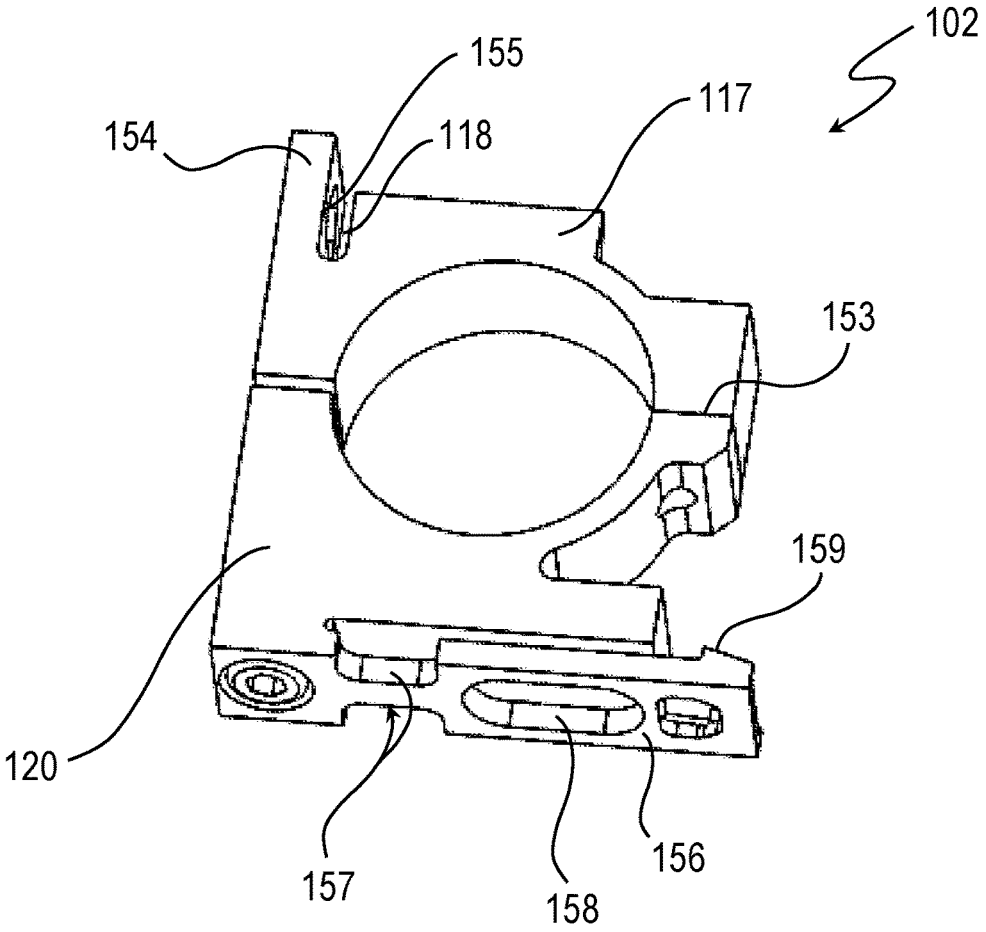
FIG. 27 shows a holder for the device according to FIGS. 21 to 25 in a perspective view.
Figure 28:
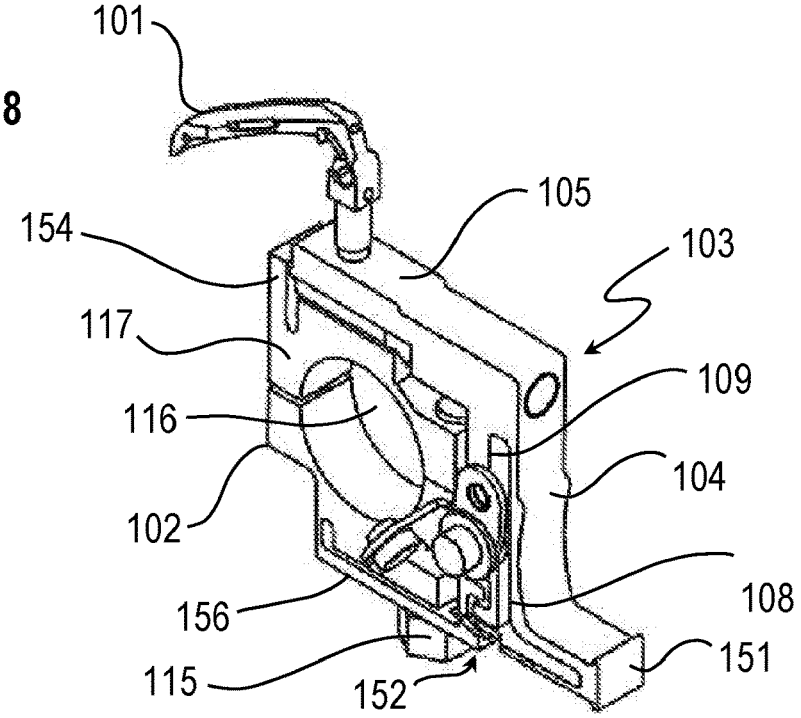
FIG. 28 shows the device according to FIGS. 21 to 25 in a perspective view.
Figure 29:
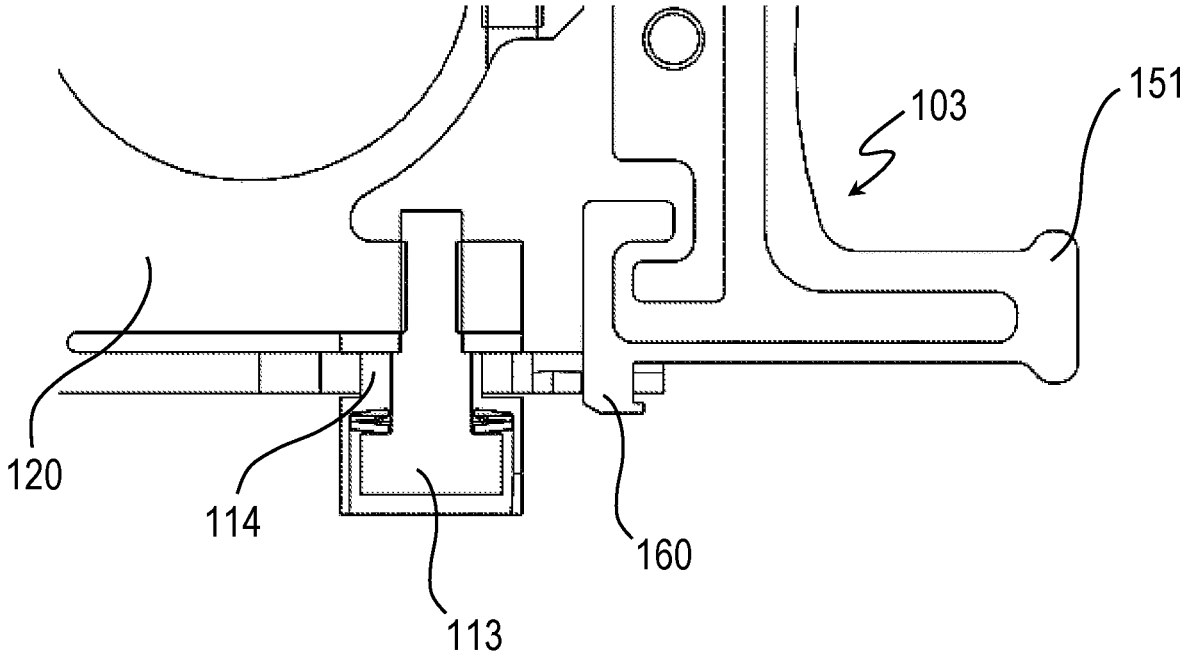
FIG. 29 shows a detailed view of the connection between the support element according to FIG. 26 and the holder according to FIG. 27.

The exact construction of the support element 103 can be seen in FIG. 26. In particular, it can be seen that the leg 104 is divided over almost its entire length into two sections 107 and 108. An opening is formed between the sections 107 and 108. The free end of the section 108 merges into the finger engagement feature 151 which has the locking element 160 at its free end and engages with a projection 109 in a corresponding recess 110 at the free end of the section 107, at the same time being movable to a limited extent in this recess 110 in the longitudinal axis direction of the section 107 so that the projection 109 can be moved in the direction of the leg 104 in order to release the locking element 160 from the locking 152 via the finger engagement feature so that the support element 103 can subsequently be removed from the holder 102.

This ensures that the support element 103 with the gripper 101 can be easily attached to or detached from the holder 102, for example in order to modify the configuration of the textile machine with regard to the number of grippers 101 without having to loosen screw connections. The support element 103 is fixed in its attachment to the holder 102 by means of the socket pin 150 whose outer diameter is matched to the inner diameter of the bore 155. In addition, the locking mechanism 152 is also designed in such a way that the locking element 160 interacts with the locking hooks 159 in a form-fit manner so that an adjustment of the gripper 101 relative to the needle not shown in detail can only be carried out to a limited extent via the adjusting device 115. For this purpose, the adjusting device 115 can have wrench flats which allow the use of a conventional combination wrench or ring spanner so that the adjusting device 115 can be easily adjusted.

In addition, the support element has 103 guide surfaces 111, 112 which interact with corresponding guides 118. These guides 118 are located in the region of the upper face of the holder 102 and may be recesses with a V-shaped cross-section. Corresponding guides can also be provided in the region of the locking element 160 or the locking hook 159 so that relative movements of the components connected to each other are prevented via a positive connection and no large clamping forces are required for this purpose as in prior art. A prismatic shape, for example with a V-shaped cross-section, can also be provided in the region between the locking element 160 and the locking hooks 159. The guide 118 and the prismatic shape are designed with openings that are aligned towards one another. In this region, the surfaces are therefore only subjected to low forces during assembly or disassembly so that the wear of these surfaces is also minimized and can practically not be detected.

With the embodiment described above, a tool-free gripper change is possible. At the same time a fine adjustment of the gripper 101 relative to the needle is possible.

The invention described above is not limited to these exemplary embodiments. Modifications are possible which also fall within the scope of the present invention. For example, instead of a toggle screw, another rotary connection can be provided in which a pin engages in a bore in the holder or the gripper shaft and produces a positive connection with a locking element by twisting. A storage for unused or additional grippers can also be provided so that these are quickly available on site when the sewing machine needs to be modified. The storage can be designed in the form of a rail and can extend over a considerable length of the sewing machine in the region of the sewing elements, especially in the region of the gripper shaft.

What is claimed is:

1. A device for fastening a gripper as a stitch forming tool on a gripper shaft of a textile machine, with a support element for the gripper, wherein the support element for the gripper is connected to a holder via a connecting element in such a way that the support element for the gripper is detachable from the holder, wherein the connecting element is designed as a toggle screw, wherein the toggle screw rotatably engages through a bore in the support element into a corresponding opening in the holder, engaging behind an abutment arranged in the opening of the holder and being provided as a projection in the opening of the holder, and wherein the holder is formed in two parts and has a seat for the gripper shaft.

2. The device according to claim 1, wherein the support element is L-shaped and has two legs, one leg having a seat for the gripper and a second leg having the toggle screw.

3. The device according to claim 1, wherein the toggle screw has a T-shaped hammer head at its end facing the holder, which hammer head engages behind the projection in the opening of the holder, and in that the toggle screw is clamped with respect to the holder by means of a spring.

4. The device according to claim 1, wherein the toggle screw is secured on the support element by a locking ring to prevent it from dropping out.

5. A device for fastening a gripper as a stitch forming tool on a gripper shaft of a textile machine, with a support element for the gripper, wherein the support element for the gripper is connected to a holder via a connecting element in such a way that the support element for the gripper is detachable from the holder by elastically bending a portion of the support element, wherein the connecting element is designed as locking mechanism, wherein the locking mechanism includes a locking hook extending from the holder in a positive connection with a locking element of the support element.

6. The device according to claim 5, wherein the support element is substantially L-shaped and has two legs extending at right angles to each other and the locking element of the locking mechanism arranged on one leg.

7. The device according to claim 5, wherein the support element has first connecting elements and wherein the holder has second connecting elements, whereby the second connecting elements of the holder correspond to the first connecting elements of the support element and whereby the first connecting elements of the support element are arranged in the second connecting elements of the holder, so that the support element is positively connected to the holder.

8. The device according to claim 5, wherein the support element includes an opening extending therethrough defining a cantilevered first section of the support element fixed to a second section of the support element, wherein the locking element is positioned at a distal end of the first section.

9. The device according to claim 5, wherein the support element has a finger engagement feature.

10. The device according to claim 5, wherein the holder is formed in two parts and has a seat for the gripper shaft.

11. The device according to claim 5, wherein the support element is L-shaped and has two legs, one leg having a seat for the gripper and a second leg having the locking element of the locking mechanism.

* * * * *